US006739477B1

(12) United States Patent
Pascual

(10) Patent No.: US 6,739,477 B1
(45) Date of Patent: May 25, 2004

(54) GOLF BALL DISPENSER

(76) Inventor: Floro Pascual, 14632 Kittridge St., N-1, Van Nuys, CA (US) 91405

( * ) Notice: Subject to any disclaimer, the term of this patent is extended or adjusted under 35 U.S.C. 154(b) by 47 days.

(21) Appl. No.: 10/122,952

(22) Filed: Apr. 12, 2002

(51) Int. Cl.[7] ..... B65H 3/30
(52) U.S. Cl. ..... 221/199; 221/301; 294/19.2
(58) Field of Search ..... 221/289, 301; 294/19.2; 473/414, 132

(56) References Cited

U.S. PATENT DOCUMENTS 4,058,336 A * 11/1977 Parkinson ..... 294/19.2
5,775,751 A * 7/1998 Nelson ..... 294/19.2
5,975,600 A * 11/1999 Hwang ..... 294/19.2
5,996,839 A * 12/1999 McLinn ..... 221/174
6,199,926 B1 * 3/2001 Lemoine ..... 294/19.2
6,419,600 B1 * 7/2002 York et al. ..... 473/517

* cited by examiner

*Primary Examiner*—Donald P. Walsh
*Assistant Examiner*—Kaitlin Joerger
(74) *Attorney, Agent, or Firm*—Gold Stein Law Offices, P.C.

(57) ABSTRACT

A golf ball dispenser for holding a plurality of golf balls. The dispenser has a handle portion, a dispensing portion, and an elongated cylindrical tube extending between the handle portion and the dispensing portion. A channel extends along the length of the dispenser and a rod is selectively slidable within the channel. The rod is connected between a trigger in the handle portion and a stopper in the dispensing portion. When at rest, the stopper keeps one or more balls within the cylindrical tube. When the trigger is depressed, the rod is lifted upward within the channel causing the rod to contact the stopper and retract it inward, thereby allowing the ball to be released from the dispenser.

12 Claims, 6 Drawing Sheets

GOLF BALL DISPENSER

BACKGROUND OF THE INVENTION

The invention relates to a golf ball dispenser. In particular, the invention is a dispenser that holds a quantity of golf balls and allows a user to dispense one ball at a time therefrom, as well as retrieve balls on the ground.

To excel at the game of golf, it is necessary to practice often. During practice sessions, it is typical for the golfer to carry a plurality of golf balls. Rather than keeping the balls in a pocket or in the golf bag, it would be convenient to have a golf ball dispenser for holding and dispensing the balls as necessary.

Thus, there exists a need for a golf ball dispenser that enables a golfer to have a convenient supply of golf balls during a practice session. Such a dispenser should enable the golfer to quickly and easily distribute one ball at a time. The dispenser should also be free standing, thereby allowing the golfer to prop up the device when not in use.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved golf ball dispenser. As such, the general purpose of the present invention, which will be described subsequently in greater detail, is to provide a new and improved golf ball dispenser which has all the advantages of the prior art and none of the disadvantages.

To attain this, the present invention essentially comprises a golf ball dispenser for holding a plurality of golf balls. The dispenser has a handle portion, a dispensing portion, and an elongated cylindrical tube extending between the handle portion and the dispensing portion. A channel extends along the length of the dispenser and a rod is selectively slidable within the channel. The rod is connected between a trigger in the handle portion and a stopper in the dispensing portion. When at rest, the stopper keeps one or more balls within the cylindrical tube. When the trigger is depressed, the rod is lifted upward within the channel causing the rod to contact the stopper and retract it inward, thereby allowing the ball to be released from the dispenser.

It is an object of the invention to produce a golf ball dispenser that dispenses one ball at a time. Accordingly, the dispenser has a handle portion equipped with a trigger, said trigger in communication with the bottom latch holding the balls in place. Thus, upon depressing the trigger, the latch is opened, allowing a ball to escape past the stopper and be dispensed onto a ground surface.

It is a further object of the invention to produce a golf ball dispenser that may hold a plurality of golf balls. Accordingly, the dispenser is equipped with the elongated cylindrical tube that can house numerous golf balls.

It is a further object of the invention to produce a golf ball dispenser that is free standing. Accordingly, the golf ball dispenser has a tripod stand that may be clamped onto the cylindrical tube. The tripod stand has legs which extend downward to meet the ground surface to allow the dispenser to be vertically self-supporting.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
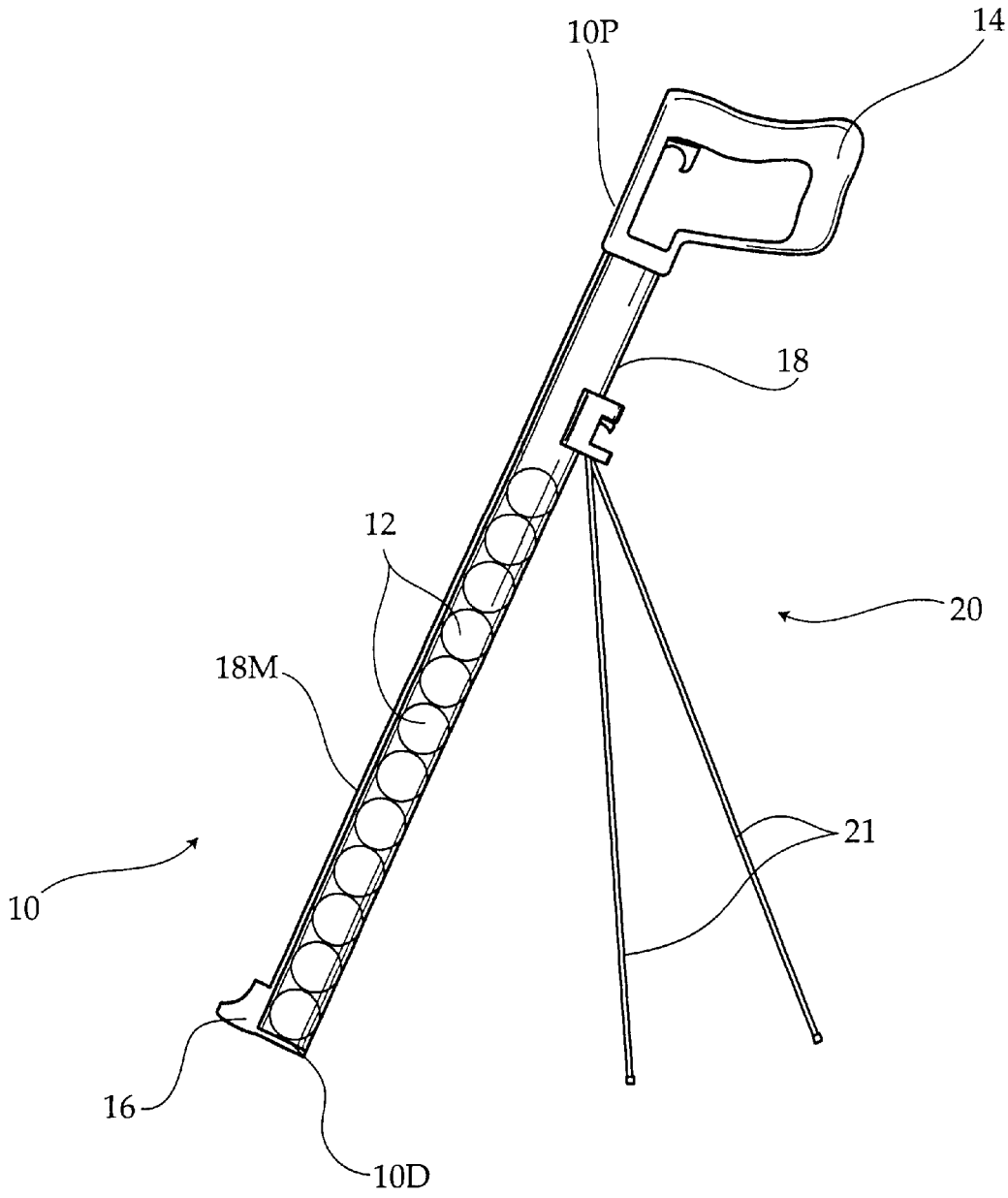
FIG. 1 is a perspective view of the golf ball dispenser.
Figure 2:
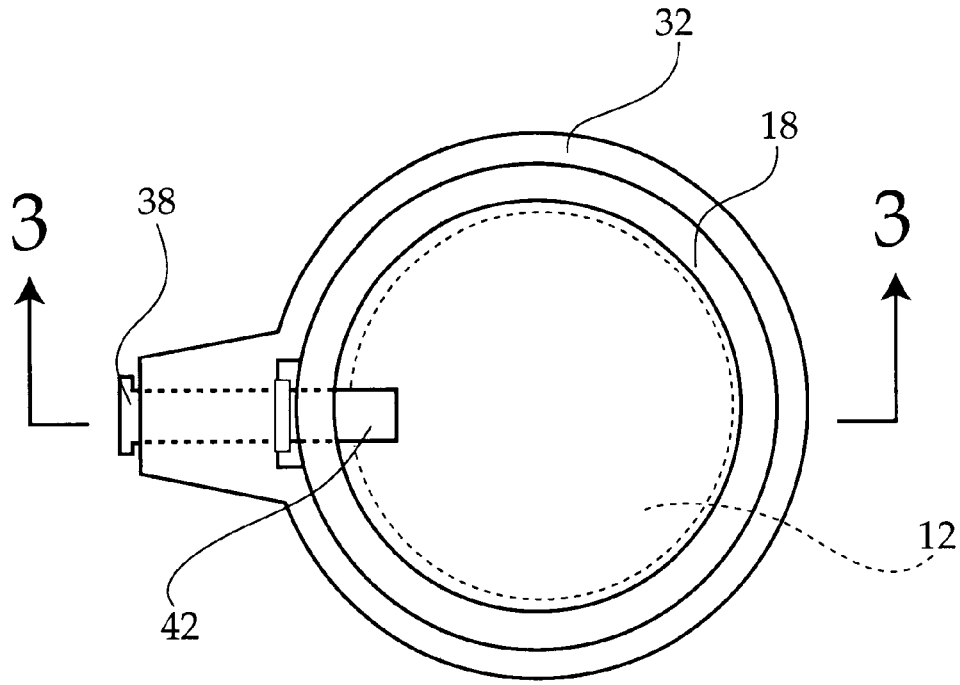
FIG. 2 is a bottom plan view of the dispenser.

10 golf ball dispenser
10P proximal end of dispenser
10D distal end of dispenser
12 golf ball
14 handle portion
14T top wall of handle portion
14B bottom wall of handle portion
14S side wall of handle portion
16 dispensing portion
18 cylindrical tube
18T top end of tube
18B bottom end of tube
18M middle portion of tube
18F front side of tube
18R rear side of tube
20 tripod assembly
21 tripod legs
22 opening in handle
24 trigger
26 channel
26T top end of channel
26B bottom end of channel
28 rod
28B bottom portion of rod
29 keyhole in rod
30 recess
32 cylindrical sleeve
32F front side of sleeve
34 stopper housing
34F stopper housing front wall
34R stopper housing rear wall
36 stopper passageway
37 narrow opening
38 button
40 threaded barrel of button
42 stopper
44 stopper shaft
45 stopper wedge
45T top edge of stopper wedge
45B inclined bottom edge of stopper wedge
46 spring
48 keyhole lower lip

DETAILED DESCRIPTION OF THE PREFERRED EMBODIMENTS

FIG. 1 illustrates a golf ball dispenser 10 for holding a plurality of golf balls 12. The dispenser 10 essentially comprises a proximal end 10P, a distal end 10D, a handle portion 14 positioned at the proximal end 10P, a dispensing portion 16 positioned at the distal end 10D, and an elongated cylindrical tube 18 extending between the handle portion 14 and the dispensing portion 16. A tripod assembly 20 that has a pair of legs 21 may be clamped onto the tube 18, near the proximal end 10P in order to support the dispenser 10 in a substantially vertical position.

The elongated cylindrical tube 18 has a top end 18T, an open bottom end 18B, a middle portion 18M extending therebetween, a front side 18F, a rear side 18R, and an interior volume defined therein. During ordinary usage, the golf balls 12 are stored within the interior volume of the tube 18. A channel 26 extends longitudinally along the front side 18F of the tube 18, between the top end 18T and the bottom end 18B, said channel 26 continuing upward into the handle portion 14 and downward into the dispensing portion 16. The channel 26 has a top end 26T and a bottom end 26B. A rod 28, having a bottom portion 28B, is selectively slidable within the channel 26, said rod 28 being in communication with the handle portion 14 and the dispensing portion 16. The rod 28 widens at the bottom portion 28B, and has a keyhole 29 extending transversely therethrough at said bottom portion 28B.

Figure 4:
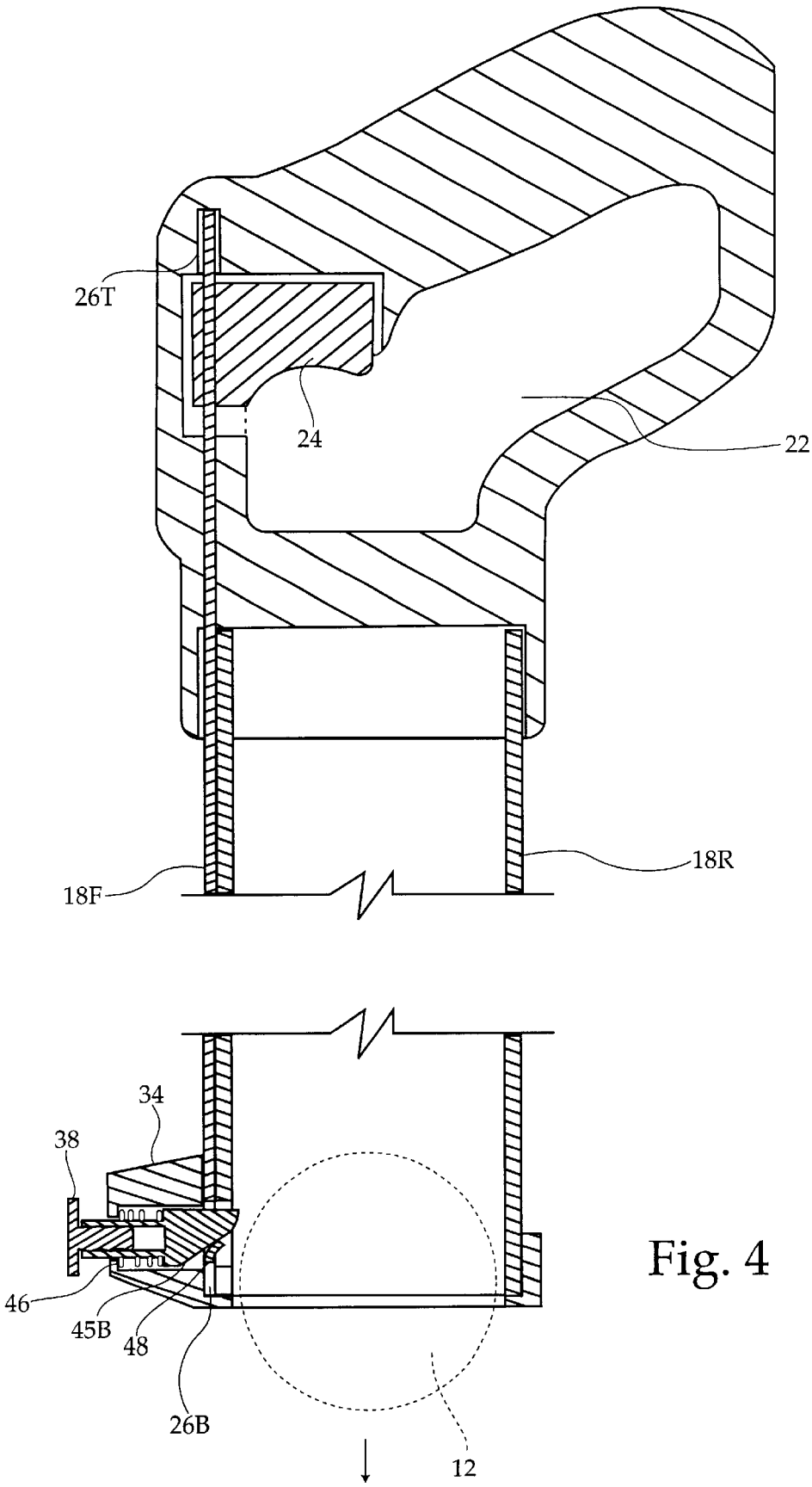
FIG. 4 is a cross sectional view similar to FIG. 3, illustrating a ball being dispensed from the dispenser.
Figure 5:
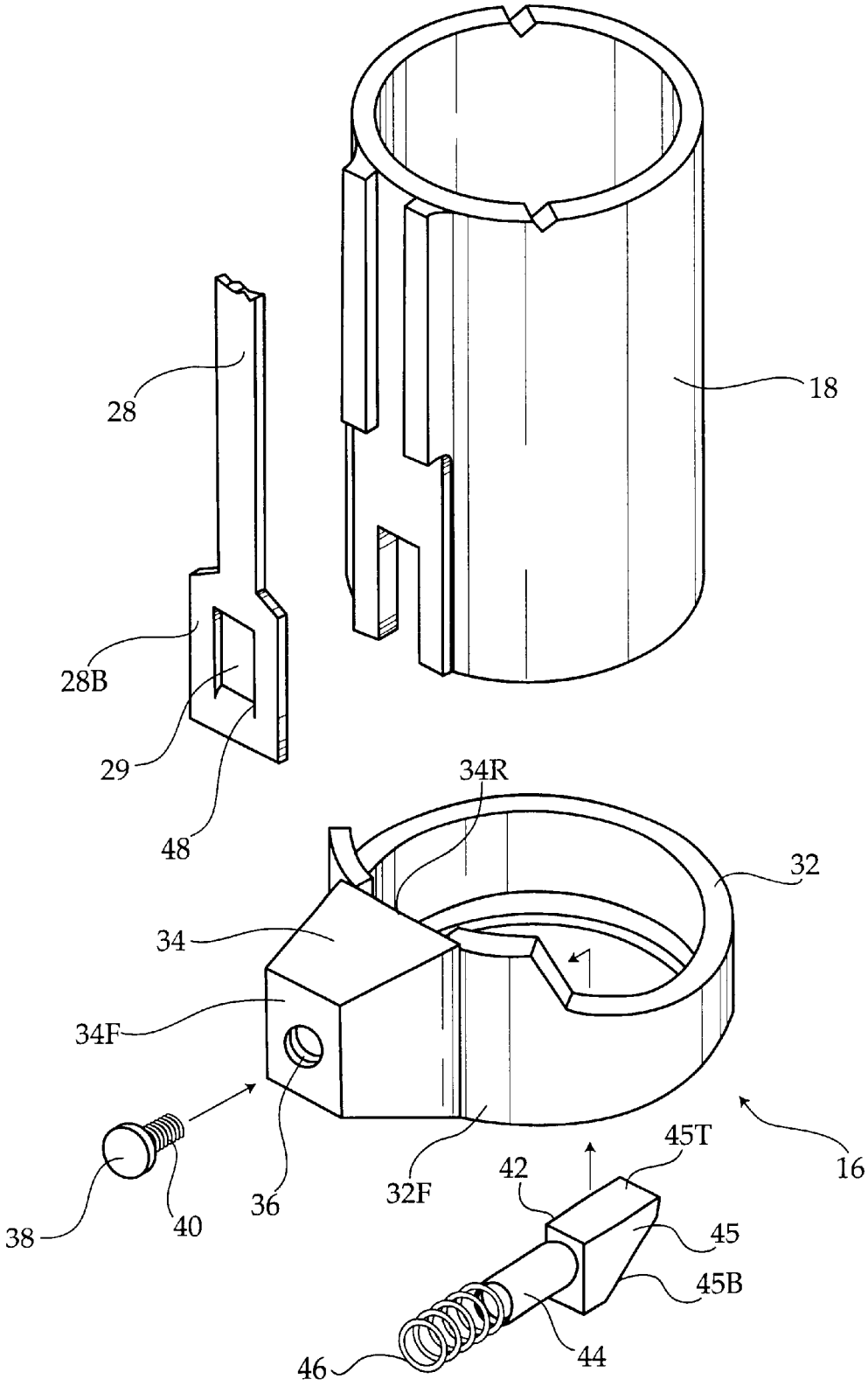
FIG. 5 is an exploded view of components of a lower portion of the cylindrical tube and the dispensing portion of the dispenser.

The handle portion 14 comprises a top wall 14T, a bottom wall 14B, and two vertical side walls 14S extending therebetween. An opening 22 is created between the side walls of the handle 14 through which a hand may be inserted for operation. A recess 30 is located within the handle, in communication with the opening 22 and the channel 26. A trigger 24 is positioned within the recess 30 in the top wall 14T, said trigger 24 extending downward from the recess 30 into the opening 22. The channel 26 begins at a point above the recess 30, extends therethrough and continues down the cylindrical tube 18. Thus the recess 30 interrupts the channel 26. The trigger 24 is attached to the rod 28 near the top portion 28T of the rod 28. When the trigger 24 is pressed upward into the recess 30, said trigger 24 causes the rod 28 to rise upward within the channel 26, as illustrated in FIG. 4. Release of the trigger 24 allows downward movement of the rod 28 within the channel 26. These movements prompt the dispensing or retrieval of the ball 12 through the dispensing portion 16 of the dispenser 10, as will be described hereinafter.

The dispensing portion 16 comprises a cylindrical sleeve 32 having a diameter slightly larger than the tube 18, wherein said sleeve 32 is fitted over the bottom portion 18B of the tube 18. The sleeve 32 has a front side 32F that corresponds with the tube front side 18F. A stopper housing 34 extends outward from the sleeve front side 32F, said stopper housing 34 having a front wall 34F and a rear wall 34R. A stopper passageway 36 runs through the stopper housing 34, from the front wall 34F to the rear wall 34R. The stopper passageway 36 has a narrow opening 37 at the front wall 34F and widens just past the front wall 34F, said stopper passageway 36 then remaining consistent in size to the stopper passageway rear wall 36R. A stopper 42 having a stopper shaft 44 and a wedge 45 extends within the stopper passageway 36, the wedge 45 is positioned at the rear wall 34R of the stopper housing 34 and the stopper shaft 44 extending past the front wall 34F. The stopper wedge 45 has a flat top edge 45T and an inclined bottom edge 45B. The stopper wedge 45 extends through the keyhole 29 in the rod 28. A spring 46 is attached around the shaft 44, and extends between the stopper wedge 45 and the front wall 34F of the stopper housing 34. A button 38 having a threaded barrel 40 is mated with the stopper shaft 44 once the stopper 42 is mounted within the stopper passageway 36, said barrel 40 extending through the narrow opening 37 in the front wall 34F of the stopper housing 34 into the stopper shaft 44.

The spring 46 biases the stopper 45 away from the front wall 34F of the stopper housing 34 while the button 38 limits travel of the stopper 45 away from the front wall 34F and into the cylindrical tube 18. The keyhole 29 is positioned adjacent to the stopper passageway 36, such that the wedge 45 extends through the keyhole 29. The rod 28 has a keyhole lower lip it 48, angled inward and upward toward the cylindrical tube center, which selectively engages the inclined bottom edge 45B of the wedge 45 as the rod 28 is lifted.

Figure 3:
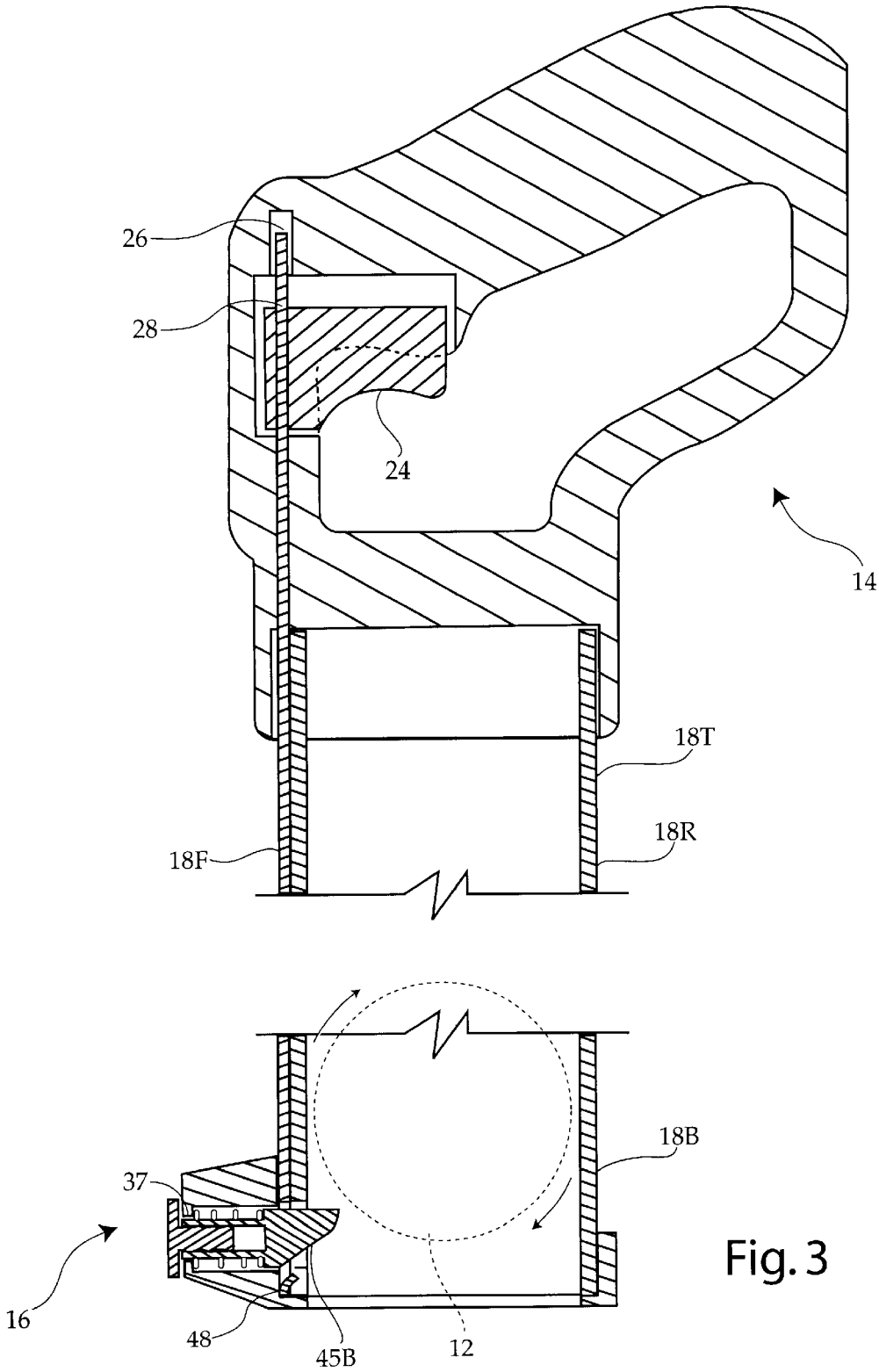
FIG. 3 is a cross sectional view thereof, taken along the line 3—3 in FIG. 2.

In use, the open bottom end 18B of the cylindrical tube 18 is placed over an area in which the ball 12 is to be dispensed. The ball 12 is kept in place within the tube 18 by the flat top edge 45T of the stopper 42, as illustrated in FIG. 3. As the trigger 24 is pressed into the recess 30, the rod 28 moves upward into the top end 26T of the channel 26, as illustrated in FIG. 4. Pulling the rod 28 upward brings the keyhole lower lip 48 of the rod 28 into contact with the inclined bottom edge 45B of the stopper wedge 45 and retracts the stopper 42 into the stopper passageway 36 by pressing upward against the stopper wedge 45 and thereby compressing the spring 46. As the top edge 45T moves outward and clears the ball 12, the ball 12 can then fall past the stopper 42 and is thereby dispensed from the open bottom end 18B of the tube 18. Releasing the trigger 24 removes the lower lip 48 from contact with the stopper wedge 45, and allows the stopper 42 to return to its resting position where it interrupts the travel of balls into and out of the open bottom end 18B. In this position, the flat top edge 42T of the stopper 42 once again prevents the ball 12 from leaving the tube 18.

Figure 6:
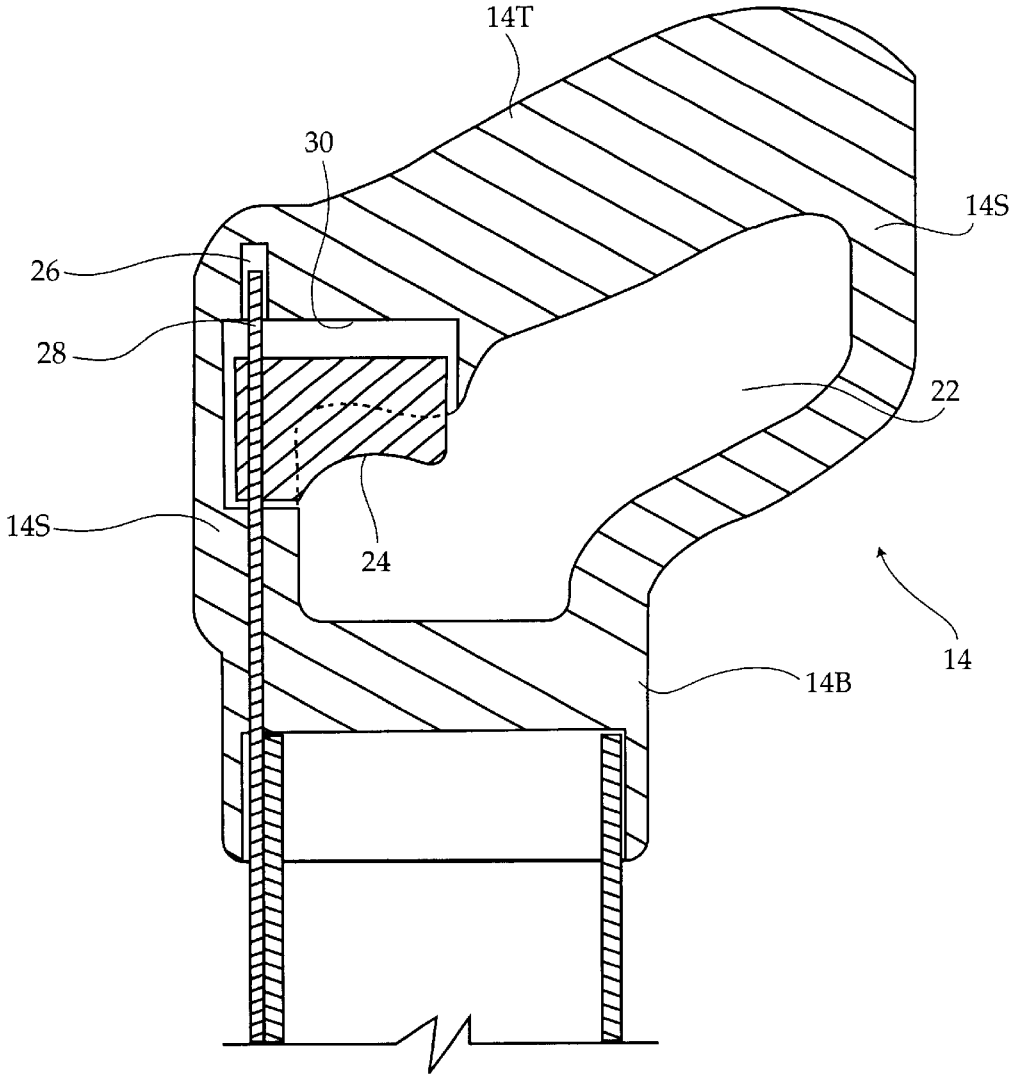
FIG. 6 is a cross sectional view thereof, illustrating retrieval of a ball into the dispenser.
Figure 6:
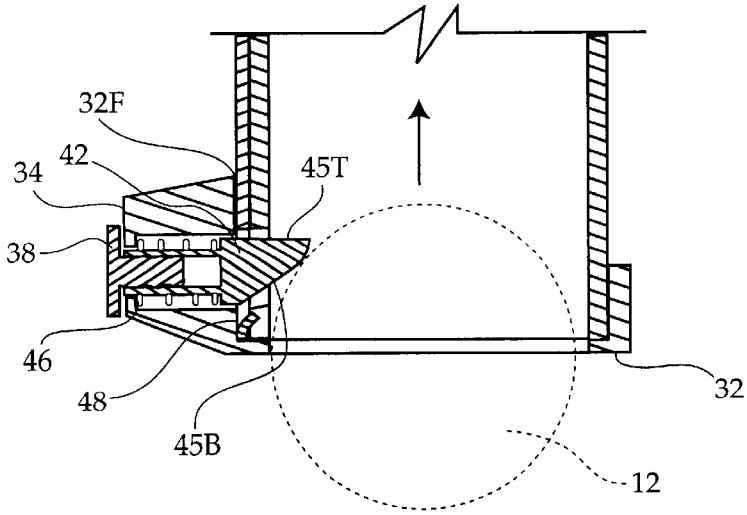

FIG. 6 illustrates the retrieval of the ball 12 into the cylindrical tube 18. The open bottom end 18B of the tube 18 is placed over the ball 12 to be retrieved. The ball 12 is brought into contact with the inclined bottom edge 45B of the stopper 42. By applying downward pressure against the ball 12, said ball 12 causes the stopper 42 to retract into the stopper passageway 36. Once the middle of the ball 12 is brought into the tube 18 past the top edge 42T of the stopper 42, the spring 46 expands back to its resting position, casing the stopper 42 to extend outward. The top edge 42T of the stopper 42 once again prevents the ball 12 from leaving the tube 18.

In conclusion, herein is presented a golf ball dispenser. The invention is illustrated by example in the drawing figures, and throughout the written description. It should be understood that numerous variations are possible, while adhering to the inventive concept. Such variations are contemplated as being a part of the present invention.

What is claimed is:

1. A golf ball dispenser for storing and dispensing a plurality of golf balls, comprising:

a handle portion, the handle portion having a top wall, a recess extending upward into the top wall, and a trigger positioned substantially within the recess;

a cylindrical tube extending downward from the handle portion, the tube having a top end, an open bottom end, a front side, and an interior volume for holding the golf balls;

a dispensing portion, the dispensing portion positioned at the bottom end of the cylindrical tube, opposite the handle portion, said dispensing portion comprising a stopper having a stopper shaft and a wedge, the wedge having a flat top edge, and an inclined bottom edge, the stopper selectively interrupting travel of the balls into and out of the open bottom end; and a rod, the rod having a top end, a bottom end wider than the top end, and a keyhole extending transversely through the bottom end, wherein the top end of the rod is in communication with the trigger of the handle portion, and the keyhole in the bottom end is in communication with the stopper of the dispensing portion, movement of the rod being selectively controlled by depression of the trigger in the handle portion, to retreat the stopper away from the tube interior to allow the balls to be dispensed.

2. The golf ball dispense as recited in claim 1, further comprising a channel extending longitudinally along the front side of the cylindrical tube, between the top end and the bottom end, said channel continuing upward into the handle portion, and being in communication with the handle recess, and downward into the dispensing portion, wherein the rod extends longitudinally within the channel, said rod being selectively slideable within the channel.

3. The golf ball dispenser as recited in claim 2, wherein a stopper housing extends outward from the front side of the sleeve, the stopper housing having a front side and a rear side, an stopper passageway running through the stopper housing from the front side to the rear side, wherein the stopper shaft and the wedge extend within the stopper passageway.

4. The golf ball dispenser as recited in claim 3, wherein the keyhole is positioned adjacent to the stopper passageway such that the wedge extends therethrough, the keyhole having a lower lip angled inward and upward toward the cylindrical tube center, said lip selectively engaging the wedge as the rod is lifted.

5. The golf ball dispenser as recited in claim 4, wherein a spring is attached around the stopper shaft and extends between the stopper wedge and the front wall of the stopper housing, wherein the spring biases the stopper away from the front wall of the stopper housing.

6. The golf ball dispenser as recited in claim 5, wherein the stopper passageway has a narrow opening at the front wall of the stopper housing, said opening widening just past the front wall and remaining consistent in size to the stopper housing rear wall.

7. The golf ball dispenser as recited in claim 6, wherein the dispensing portion further comprises a button having a threaded barrel, said button being selectively mateable with the stopper shaft and the barrel extending through the narrow opening in the front wall of the stopper housing into the stopper shaft, wherein the button limits travel of the stopper past the front wall of the stopper housing.

8. The golf ball dispenser as recited in claim 7, further comprising a tripod assembly having legs, the assembly being clamped onto the cylindrical tube, wherein the legs extend downward to meet the ground surface.

9. The golf ball dispense as recited in claim 8, wherein the handle portion further comprises a bottom wall and two vertical side walls extending between the top wall and the bottom wall, wherein an opening is created between the side walls of the handle to accommodate a user's hand.

10. A method of dispensing a golf ball from a golf ball dispenser, the golf ball dispenser comprising a handle portion, a cylindrical tube having an open bottom end, and a dispensing portion, the handle portion having a trigger, the dispensing portion having a stopper housing, a stopper passageway extending through the stopper housing, and a stopper positioned within the stopper passageway, comprising the steps of:

maintaining balls within the cylindrical tube by the stopper;

positioning the dispenser over an area on which the golf ball is to be dispensed;

allowing the ball to leave the cylindrical tube through the open bottom end by retracting the stopper into the stopper passageway by depressing the trigger; and maintaining any remaining balls within the tube by extending the stopper back into the cylindrical tube to prevent additional balls from leaving the tube by releasing the trigger by the user.

11. The method of dispensing a golf ball as recited in claim 10, the dispenser further comprising a rod extending in a channel running the length of the dispenser, the dispenser having a top end, the rod having a top end, a wide bottom end, and a keyhole extending transversely through the bottom end, the keyhole having a lower lip, and the stopper further comprising a stopper wedge having a flat top edge and an inclined bottom edge, wherein the step of allowing the ball to leave the cylindrical tube through the open bottom end by retracting the stopper into the stopper passageway, further comprises the step of:

bringing the keyhole lower lip into contact with the inclined bottom edge of the stopper wedge by raising the rod to the top end of the channel in response to depression of the trigger.

12. The method of dispensing a golf ball as recited in claim 11, wherein the step of extending the stopper back into the cylindrical tube to prevent additional balls from leaving, further comprises the steps of:

lowering the rod by releasing the trigger;

removing the keyhole lower lip from upward pressure against the inclined bottom edge of the stopper wedge; and forcing the stopper outward from the stopper passageway by allowing the spring to expand to a resting position.

* * * * *